United States Patent [19]

Sandelius

[11] 3,978,790

[45] Sept. 7, 1976

[54] HIGH ALTITUDE SONOBUOY

[75] Inventor: John Robert Sandelius, Seattle, Wash.

[73] Assignee: The Boeing Company, Seattle, Wash.

[22] Filed: Oct. 23, 1975

[21] Appl. No.: 625,231

[52] U.S. Cl. ..... 102/4; 102/37.1; 244/3.25; 244/3.27; 244/138 A

[51] Int. Cl.[2] ..... F42B 25/02

[58] Field of Search ..... 102/4, 34.1, 37.1; 244/138 A, 3.27, 3.28, 3.29, 3.25

[56] References Cited

UNITED STATES PATENTS

| | | | |
|---|---|---|---|
| 2,044,819 | 6/1936 | Taylor | 102/4 |
| 2,990,149 | 6/1961 | Samms | 244/138 A |
| 3,057,589 | 10/1962 | Nutkins et al. | 102/4 X |
| 3,598,345 | 8/1971 | Suter | 244/3.28 X |
| 3,643,599 | 2/1972 | Hubich | 102/4 |

*Primary Examiner*—David H. Brown
*Attorney, Agent, or Firm*—Donald A. Streck

[57] ABSTRACT

A sonobuoy for launching at high altitudes from present sonobuoy launching tubes. A plurality of spring loaded stabilizing fins are held in place adjacent the body of the sonobuoy by rotovanes in their stored position. Upon launching the sonobuoy from an aircraft, the stabilizing fins assume their stabilizing position substantially perpendicular to the body of the sonobuoy due to the spring action but are held in place by the stored rotovanes. Upon reaching a lower altitude, the rotovanes are released to allow rotochute action to slow the descent of the sonobuoy. Upon deployment of the rotovanes to their operating position, the stabilizing fins previously held in place by the stored rotovanes separate to allow proper rotochute action.

1 Claim, 6 Drawing Figures

Fig. 4
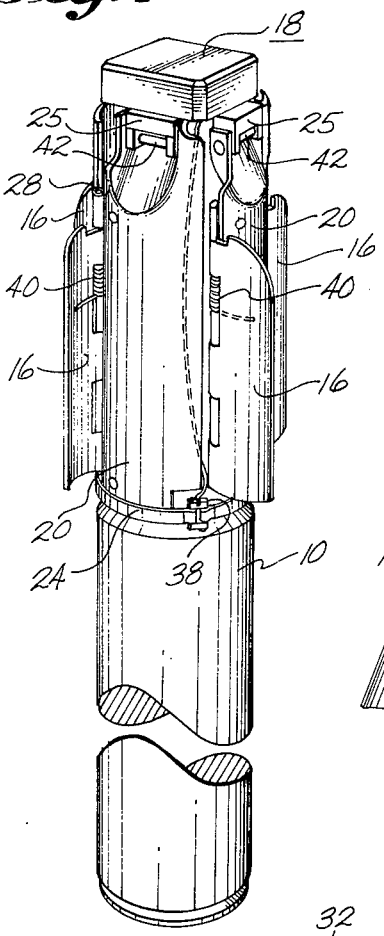
Fig. 5
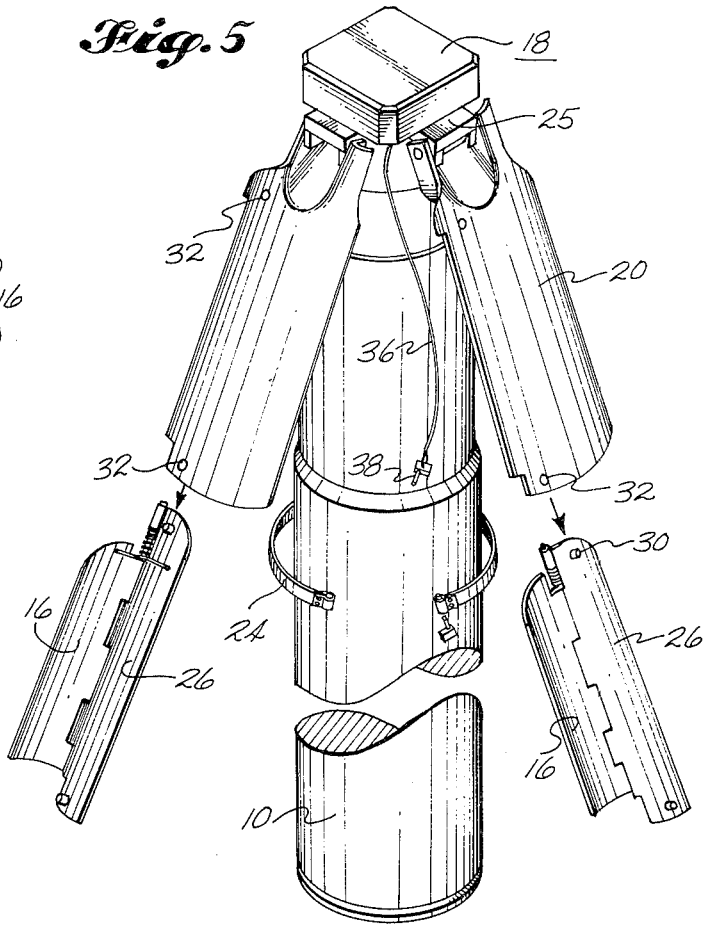
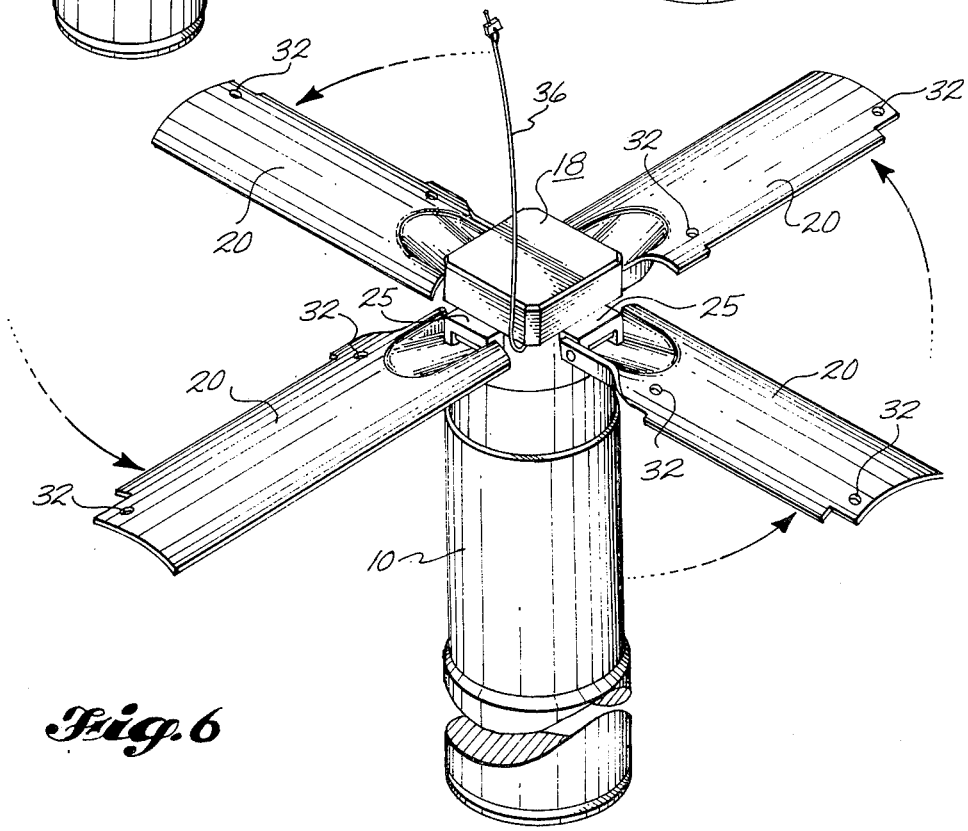
Fig. 6

HIGH ALTITUDE SONOBUOY

BACKGROUND OF THE INVENTION

1. Field of the Invention

Relates to SONAR devices and more particularly to airplane dropped submarine locating devices known as sonobuoys.

2. Description of the Prior Art

Presently, final submarine localization and attack phases by ASW (anti-submarine warfare) aircraft must be carried out at low altitude (less than 5,000 feet). This exposes the aircraft to potential underwater-to-air missile attack, leads to poor fuel economy and small radio-radar horizon, decreases aircraft speed and fatigue life and gives poor crew ride. The use of a Cubic-type Sonobuoy Reference System in conjunction with the high altitude sonobuoy would allow ASW search operations to be carried out from high altitudes. Present sonobuoys are not feasible for high altitude deployment because of potential placement errors in wind conditions.

For high altitude deployment, the sonobuoy must be equipped with means for causing the initial fall according to a ballistic trajectory and then means for slowing the rate of descent prior to water impact. The sonobuoy thus equipped must also be capable of storage and launch from standard sonobuoy launching tubes presently installed on ASW Aircraft.

Rotovanes have proved to be a satisfactory means for slowing the descent of a sonobuoy launched from lower altitudes. Baroswitches are well known as devices for activating a mechanism as a function of altitude. Fins have been known for their stabilizing effect since the invention of the arrow. Combining these elements with a sonobuoy such that they can be stored and deployed from a standard sonobuoy launching tube in the manner of the present invention, however, does not appear in the prior art. Various combinations of folding fins and breaking devices were disclosed by a search of the prior art but none disclosed or suggested the apparatus of the present invention.

The U.S. Pat. No. 3,057,589 of Nutkins, et al. discloses a two position rotor that serves first as a fin and then as a rotor. This apparatus, however, does not have the required third position for use on a sonobuoy wherein the fin is also folded so that the sonobuoy can be stored in the launch tube.

The patents of Suter (U.S. Pat. No. 3,588,004 and 3,598,345) disclose a folding brake and fin combination which could be mounted on a sonobuoy to fit in a launching tube. The disclosed apparatus, however, requires that the brake and fin deploy simultaneously where, for the intended purposes, the fin must deploy separate from the brake.

The device of Jackson as disclosed in U.S. Pat. No. 3,098,445 has the same limitation as that of Nutkins, et al. in that in the fin position the dual purpose rotor does not fold to allow storage in the launch tube.

The missile of Hubich disclosed in his U.S. Pat. No. 3,643,599 most closely approximates the functions of the present invention. Hublich combines fins, breaking and folding in one device. The manner is patentably distinct from the present invention, however, in that a drag brake having no lift is employed and, to function and fold, the fin is required to have its major axis perpendicular to the missile body axis instead of the conventional and more effective method of having the major axis parallel to the missile body axis as used by the present invention, Jackson, Suter, and Nutkins, et al.

Thus, it is an object of the present invention to provide a sonobuoy having effective stabilizing fins and a rotovane breaking device employing airfoil rotors with lift which can be stored and launched from a conventional sonobuoy launch tube.

It is a further object of the present invention to provide a sonobuoy with folding fins and rotovanes wherein the fins and rotovanes can be deployed separately.

DESCRIPTION OF THE DRAWINGS

FIG. 4 shows the present sonobuoy in its fin erect configuration.

FIG. 5 shows the present sonobuoy going from fin erect to rotovane erect configuration.

FIG. 6 shows the present sonobuoy in its rotovane erect configuration.

DESCRIPTION OF THE PREFERRED EMBODIMENT

Figure 1:
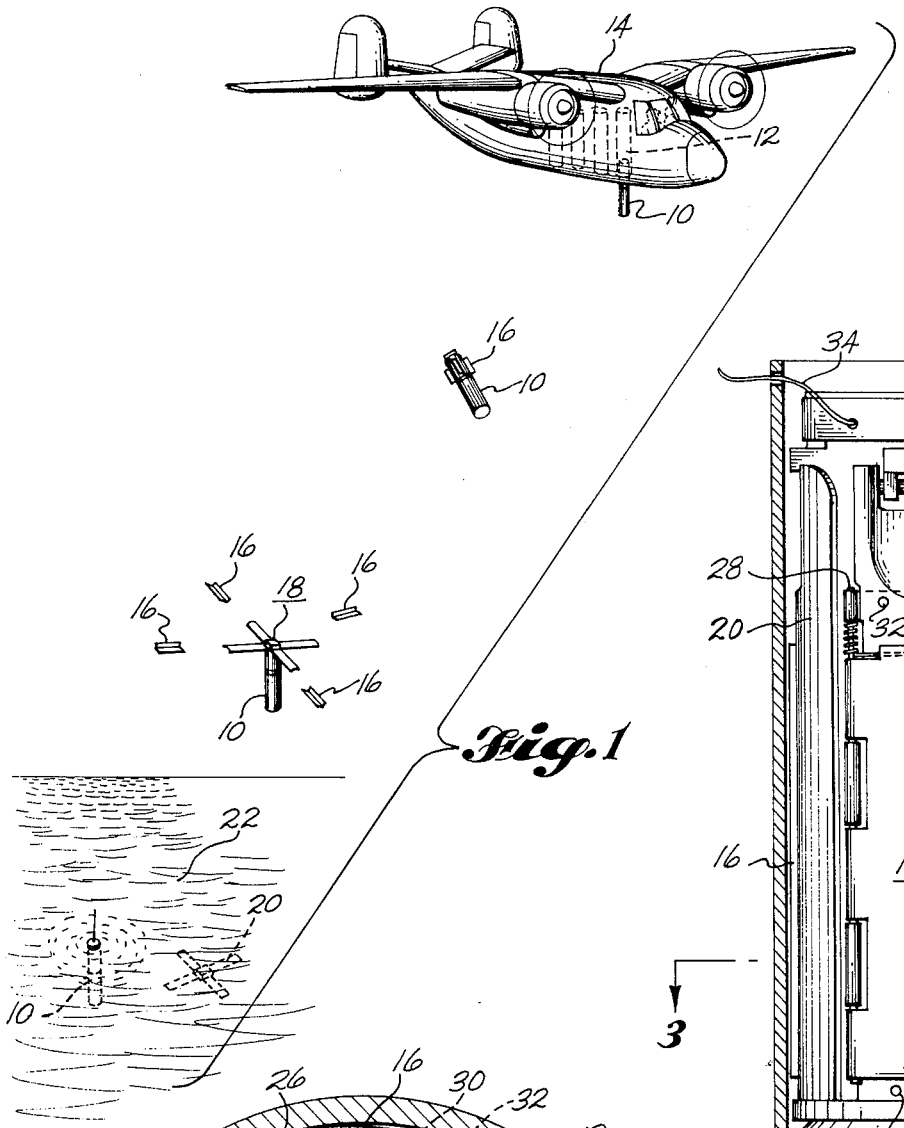
FIG. 1 depicts the sequence of operations of the present invention.

The sequence of operation required of a sonobuoy 10 employing the present invention is shown in FIG. 1. The sonobuoy 10 is stored in and launched from storage tube 12 in airplane 14. As sonobuoy 10 is launched and clears storage tube 12, fins 16, previously held in their folded position adjacent sonobuoy 10 by storage tube 12, spring into their deployed position to guide sonobuoy 10 on a ballistic trajectory during its initial fall. Upon reaching a lower preselected altitude, baroswitch assembly 18 releases rotovanes 20 from their stored position adjacent sonobuoy 10 allowing fins 16 to separate from sonobuoy 10 and rotovanes 20 to assume their operational position. Sonobuoy 10 then autorotates slowly to the water 22 where it begins its submarine locating functions.

Figure 2:
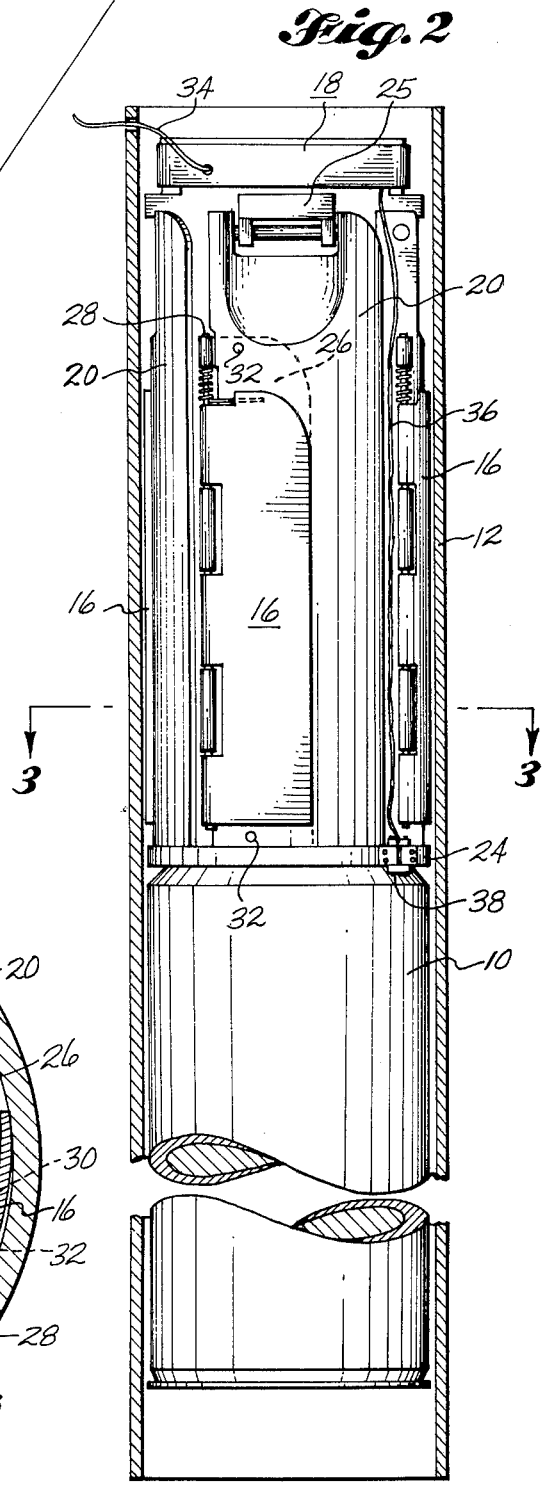
FIG. 2 shows the sonobuoy of the present invention in its stored position.
Figure 3:
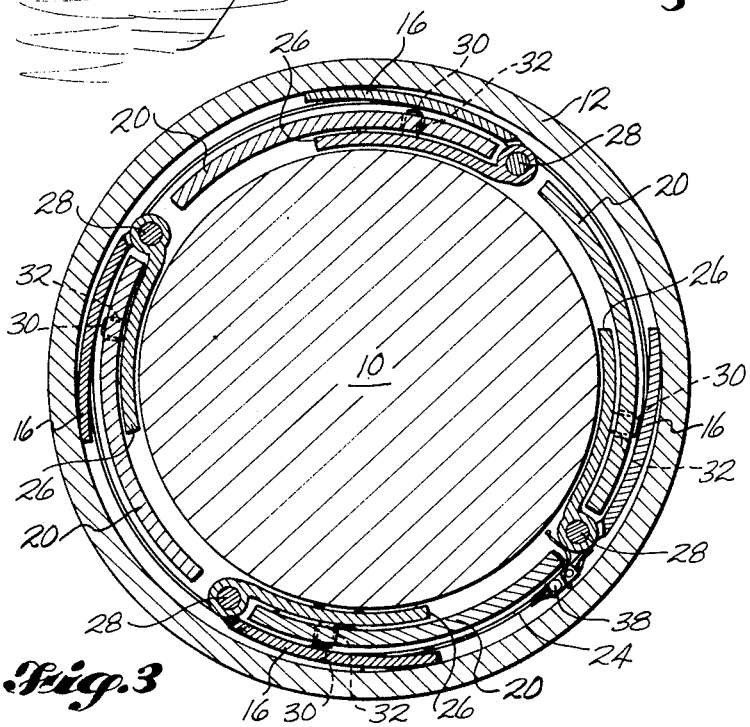
FIG. 3 is a cross-section through the sonobuoy of FIG. 2 to show the folding of the fins and rotovanes.

This sequence and the apparatus that comprises the present invention is shown in greater detail in FIG. 2 through FIG. 6. Referring first to FIG. 2 and FIG. 3, the sonobuoy 10 is shown in its stored position inside storage tube 12. Rotovanes 20 are folded adjacent sonobuoy 10 and held in place by retaining ring 24. Each of the rotovanes 20 is hingedly affixed to rotatable collar 25 carried on the tail of sonobuoy 10. Fin retaining leaf 26 is sandwiched between rotovane 20 and sonobuoy 10 with hinge pin 28 carried by fin retaining leaf 26 adjacent one edge of rotovane 20 so that fin 16 being rotatably attached to hinge pin 28 can be folded close adjacent the outer surface of rotovane 20 as shown. Fin retaining leaf 26 has retaining pins 30 thereon which fit into holes 32 in rotovane 20 to prevent fin retaining leaf 26 from moving from between rotovane 20 and sonobuoy 10 when rotovane 20 is in its folded position. As shown in FIG. 2, the sonobuoy 10 is ready for launching from an aircraft. Arming wire 34, tethered to the storage tube 12, closes an electrical switch (not shown) and pulls a pin (not shown) freeing an activating solenoid (not shown) all contained in baroswitch assembly 18 carried by sonobuoy 10. The system is then ready for operation when baroswitch assembly 18 closes the circuit upon reaching the correct altitude. Release wire 36 is connected between the solenoid of baroswitch assembly 18 and release assembly 38 holding retaining ring 24 in place around rotovanes 20.

Referring now to FIG. 4, the sonobuoy 10 is shown during its ballistic fall. Arming wire 34 has been pulled during release and baroswitch assembly 18 is ready to operate upon reaching the proper altitude. Fins 16 previously held adjacent rotovanes 20 by storage tube 12 have been urged into their erect position substantially perpendicular to sonobuoy 10 by springs 40 carried by hinge pin 28 and guide the sonobuoy 10 in its ballistic trajectory.

Upon reaching the desired altitude for descent slowing, the sequence of FIG. 5 begins. Baroswitch assembly 18 operates pulling release wire 36 with release assembly 38 attached. Release assembly 38 is pulled from retaining ring 24 which separates and releases rotovanes 20. Wind pressure lifts rotovanes 20 from their stored position adjacent sonobuoy 10. Rotovanes 20 begin to move about their hinge points where they are attached to rotatable collar 25. As rotovanes 20 move away from sonobuoy 10, fin retaining leaf 26 is no longer held securely in place. As soon as retaining pins 30 can clear holes 32, fins 16 and attached fin retaining leafs 26 separate from sonobuoy 10 and blow away. Rotovanes 20 continue to pivot about rotovane pivot pins 42 providing the hinged attachment of rotovanes 20 to rotatable collar 25 from the wind pressure until they are in the fully erect position shown in FIG. 6. Rotatable collar 25 is rotatably carried by sonobuoy 10 such that as wind pressure is directed against rotovanes 20 a rotary vector results against rotovanes 20 and rotatable collar causing them to rotate and create a lifting force on sonobuoy 10. This autorotating action allows sonobuoy 10 to descend slowly.

Having thus described by invention, I claim:

1. In a sonobuoy, the improvement for adapting the sonobuoy for high altitude deployment comprising:

a. a rotatable collar rotatably carried by the sonobuoy;

b. a plurality of rotovanes hingedly carried by said rotatable collar, said rotovanes being movable between a stored position adjacent the sonobuoy and an operating position wherein said rotovanes and said rotatable collar will revolve from wind pressure when the sonobuoy is falling in the atmosphere, said rotovanes being so shaped as to lie close adjacent the sonobuoy such that the sonobuoy will fit in a sonobuoy launching and storage tube with the rotovanes in the stored position and provide a lifting force on the sonobuoy when the rotovanes are rotated by wind pressure in the operating position;

c. a plurality of fin retaining leaves being shaped to fit between said rotovanes and the sonobuoy and be held in such position by said rotovanes when said rotovanes are in their stored position, said fin retaining leaves having hinge means carried adjacent one edge of said rotovanes when said fin retaining leaves are being held in place between said rotovanes and the sonobuoy;

d. a plurality of fins carried by said hinge means of said fin retaining leaves, said fins having springs operatively connected thereto to provide a spring bias to urge said fins from a stored position folded close adjacent said rotovanes when said rotovanes are in their stored position to an operating position substantially perpendicular to the sonobuoy to guide the sonobuoy in a ballistic trajectory when th sonobuoy is falling in the atmosphere;

e. retaining means shaped to fit around the sonobuoy and hold said rotovanes in their stored position while allowing said fins freedom to move from their stored position to their operating position, said retaining means having release means which when actuated will allow said retaining means to release said rotovanes from their stored position and move to their operating position; and, f. altitude responsive means carried by the sonobuoy and operably connected to said release means of said retaining means, said altitude responsive means being set to operate said release means at the preselected altitude where it is desired that ballistic fall of the sonobuoy end and slowed descent by autorotation of said rotovanes begins.

* * * * *